US006225038B1

(12) United States Patent
Smith et al.

(10) Patent No.: US 6,225,038 B1
(45) Date of Patent: May 1, 2001

(54) THERMALLY PROCESSABLE IMAGING ELEMENT

(75) Inventors: Dennis E. Smith, Rochester, NY (US); Sharon M. Melpolder, Yapavai Hills, AZ (US); James R. Bennett, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/433,896

(22) Filed: Nov. 4, 1999

(51) Int. Cl.[7] ..... G03C 1/498

(52) U.S. Cl. ..... 430/523; 430/617; 430/619; 430/950

(58) Field of Search ..... 430/523, 619, 430/617, 531, 961, 950

(56) References Cited

U.S. PATENT DOCUMENTS

| | | | |
|---|---|---|---|
| 3,080,254 | | 3/1963 | Grant, Jr. . |
| 3,457,075 | | 7/1969 | Morgan et al. . |
| 3,933,508 | | 1/1976 | Ohkubo et al. . |
| 4,741,992 | | 5/1988 | Przezdziecki . |
| 4,828,971 | | 5/1989 | Przezdziecki . |
| 5,310,640 | | 5/1994 | Markin et al. . |
| 5,547,821 | | 8/1996 | Melpolder et al. . |
| 5,750,328 | | 5/1998 | Melpolder et al. . |
| 5,783,380 | * | 7/1998 | Smith et al. ..... 430/619 |

OTHER PUBLICATIONS

Research Disclosure, "Photothermographic Silver Halide Systems" #17029, Jun. 1978.

* cited by examiner

*Primary Examiner*—Thorl Chea
(74) *Attorney, Agent, or Firm*—Edith A. Rice

(57) ABSTRACT

This invention comprises thermally processable imaging element comprising:

(a) a support, (b) a thermally processable imaging layer on one side of the support; and (c) a protective layer comprising a binder and matte particles comprising a crosslinked polymer, wherein the protective layer has been applied as a solution of binder and matte particles in a coating solvent in which the binder is soluble and the matte particles are swellable to the extent of about 160 to about 390%.

7 Claims, No Drawings

THERMALLY PROCESSABLE IMAGING ELEMENT

FIELD OF THE INVENTION

This invention relates a thermally processable imaging element comprising polymeric matte particles in at least one layer thereof.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, Research Disclosure, June 1978, Item No.17029 and U.S. Pat. Nos. 3,080,254, 3,457,075 and 3,933,508.

The aforesaid thermally processable imaging elements are often provided with at least one protective layer. The protective layer can be a overcoat layer or a backing, or the element may have both a protective overcoat layer and a protective backing layer. The overcoat layer is an outer layer on the side of the support on which the imaging layer is coated and the backing layer is an outer layer on the opposite side of the support. Generally these layers are the outermost layers of the element. Other layers which are advantageously incorporated in thermally processable imaging elements include subbing layers and barrier layers.

To be fully acceptable, a protective layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the protective layer to a contiguous layer of the element, (e) be free from cracking and undesired marking, such as abrasion marking, during manufacture, storage, and processing of the element, (f) provide adequate conveyance characteristics during manufacture and processing of the element, (g) not allow blocking, ferrotyping adhering or slippage of the element during manufacture, storage, or processing and (h) not induce undesirable sensitometric effects in the element during manufacture, storage or processing.

A protective layer also serves several important functions which improve the overall performance of thermally processable imaging elements. For example, the protective layer serves to improve conveyance, reduce static electricity, reduce dirt and eliminate formation of Newton Rings.

A typical protective layer for thermally processable imaging elements comprises poly(silicic acid) as described in U.S. Pat. Nos. 4,741,992, 4,828,971, 5,310,640 and 5,547,821. Advantageously, water-soluble hydroxyl containing monomers or polymers are incorporated in the protective layer together with the poly (silicic acid). Other hydrophilic and hydrophobic protective layers are also known. These include those formed from poly(methyl methacrylate), cellulose acetate, crosslinked polyvinyl alcohol, terpolymers of acrylonitrile, vinylidene chloride, and 2-(methacryloyloxy) ethyltrimethylammonium methosulfate, crosslinked gelatin, polyesters and polyurethanes.

With photothermographic elements, it is usually necessary to produce a "duplicate image" of that on the imaging element for low cost dissemination of the image. The duplication process is typically a "contact printing" process where intimate contact between the photothermographic imaging element and the duplication imaging element is essential. Successful duplication of either continuous rolls or cut sheets is dependent on adequate conveyance of the imaging element through the duplication equipment without the occurrence of slippage or sticking of the protective overcoat layer of the photothermographic imaging element in relation to any of (1) the duplication equipment, (2) the duplication imaging element or (3) the backing layer of subsequent portions of the photothermographic imaging element (adjacent convolutions of the photothermographic imaging element if in a continuous roll or adjacent "cut sheets" in a stacking configuration). The latter of these phenomena is often referred to as "blocking".

The addition of matte particles to either or both protective layers of a thermally processable imaging element is commonly used to prevent adhering or "blocking" between the protective overcoat layer and adjacent backing layer with which it is in intimate contact during manufacture, storage, processing and photoduplication. Furthermore, the matte particles are desirable to impart desired frictional characteristics to the protective layers to achieve proper conveyance without sticking, blocking or slippage during the duplication process. The amount and particle size of the matte must be controlled as the wrong particle size and/or amount can cause conveyance, duplicate image quality and vacuum draw down problems. Another problem associated with the use of matte particles in protective layers of thermally processable imaging elements is dusting that comes from inadequate adhesion between the matte particles and the binder. In particular, larger matte particles are required to improve film roughness, but larger matte particles are more easily dislodged from the protective overcoat layer. The dislodged, or dusted, matte is can no longer provide the desired film roughness and it accumulates on the film or equipment surfaces causing various defects such as scratches, visible spots etc.

The properties of mattes are very important to their incorporation into film products. The matte improves or tailors the transport and vacuum smoothness properties of the final film product and can also provide increased protection from ferrotyping and blocking of the raw and processed film. The glass transition temperature (Tg) and composition of the matte determines the effect of processing conditions on the final matte properties, i.e. swellability, size, surface roughness, etc.

Three very important properties of a matte that determines whether it is best suited for use in a particular product application are:

1. particle size and size distribution
2. ease of dispersability in coating solutions
3. stability of matte to manufacturing and processing conditions to control agglomeration, swelling, "squashing", and suspension in coating solutions.

The use of limited coalescence made mattes as described in U.S. Pat. No. 5,750,378 has greatly improved particle size distribution and has resulted in a decrease of the over-size population of the as-made matte. This property allows us to use mattes without additional classification to remove the unwanted larger sized particles which in the case of films that use magnification of the final product could give unacceptable visual appearance and/or obscure data of the final product.

The use of methyl methacrylate and other high Tg polymers with and without cross-linking provides a matte that does not change in dimensions in systems when the matte is exposed to high processing temperatures, i.e. near the Tg of the support.

PROBLEM TO BE SOLVED BY THE INVENTION

To provide a thermally processable imaging element with the desired degree of roughness, relatively large matte particles should be used. However, when relatively large matte particles are used, the particles have relatively poor adhesion to the binder of the protective layer (i.e. there is "dusting" of the matte particles dislodged from the imaging element, as previously mentioned and discussed in more detail below). This invention provides a thermally processable imaging element with acceptable surface roughness as measured by vacuum drawdown while also providing superior adhesion of the matte.

SUMMARY OF THE INVENTION

We have now discovered that dusting of matte beads is inhibited if the matte beads comprise a cross-linked polymer which swells in the coating solvent within specified parameters.

One aspect of this invention comprises a thermally processable imaging element comprising:

(a) a support, (b) a thermally processable imaging layer on one side of the support; and (c) a protective layer comprising a binder and matte particles comprising a crosslinked polymer, wherein the protective layer has been applied as a solution of binder and matte particles in a coating solvent in which the binder is soluble and the matte particles are swellable to the extent of about 160 to about 390%.

ADVANTAGEOUS EFFECT OF THE INVENTION

This invention provides a thermally processable imaging element having a protective layer containing matte particles in which the matte particles have improved adhesion to the binder of the protective layer.

DETAILED DESCRIPTION OF THE INVENTION

The term "protective layer" is used in this application to mean an image insensitive layer which can be an overcoat layer, that is a layer that overlies the image sensitive layer(s), or a backing layer, that is a layer that is on the opposite side of the support from the image sensitive layer(s). The imaging element can have a protective overcoat layer and/or a protective backing layer and/or an adhesive interlayer. The protective layer is not necessarily the outermost layer of the imaging element. The protective layer is preferably a transparent or translucent backing layer.

A wide variety of materials can be used to prepare a protective layer that is compatible with the requirements of thermally processable imaging elements. The protective layer should be transparent or translucent and should not adversely affect sensitometric characteristics of the photothermographic element such as minimum density, maximum density and photographic speed. In accordance with this invention, the thermally processable imaging element comprises at least one protective layer comprising a hydrophobic (soluble in organic solvent) polymeric binder. Preferred hydrophobic binders are those formed from polymerization of acrylic monomers, such as acrylic acid, or methacrylic acid, and their alkyl esters giving polymers such as poly (methyl methacrylate), polyethylmethacrylate, polybutylmethacrylate, polyethylacrylate, polybutylacrylate, and the like, cellulose acetate, crosslinked polyvinyl alcohol, terpolymers of acrylonitrile, vinylidene chloride, and 2-(methacryloyloxy)ethyltrimethylammonium methosulfate, polyesters and polyurethanes. Preferably, the protective layer is a hydrophobic backing layer. More preferably the protective layer is formed from polymerization of acrylic monomers. Most preferably the protective layer comprises a poly(methyl methacrylate) binder.

In embodiments of the invention in which only one protective layer (the overcoat or the backing) is in accordance with this invention, the other protective layer may comprise a hydrophobic or a hydrophilic polymeric binder. If a hydrophilic layer is used for the other protective layer, the binder preferably comprises poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful.

The protective layer used in accordance with this invention further comprises crosslinked polymeric matte particles. Matte particles and the way they are used are further described in U.S. Pat. Nos. 5,468,503, 5,750,328 and 5,783,380. In general, polymeric matte beads suitable for use herein comprise polymeric resins which are chemically, physically and photographically inert. The preferred method of making polymeric matte beads is by suspension polymerization of acrylic and styrenic monomers. Methyl methacrylate and styrene are preferred monomers because they are inexpensive, commercially available materials which make acceptable polymeric matte beads. Other acrylic and styrenic monomers will also work. Methyl methacrylate is preferred.

In accordance with the invention, the polymeric matte is sufficiently crosslinked to provide 160 to 390 vol. % swelling of the matte in the coating solvent within 4 hours of contact. Preferably the matte is sufficiently crosslinked to provide about 170 to about 400 vol. %, and most preferably to provide about 185 to about 350 vol. % swelling of the matte in the coating solvent. Any co-monomer with more than one ethylenically unsaturated group can be used in the preparation of the polymeric matte to provide the crosslinking functionality, such as divinylbenzene and ethylene glycol dimethacrylate. The critical amount of crosslinking monomer required to be incorporated into the matte to restrict swelling of the polymeric matte to between about 160 and about 390 vol. % will depend upon the composition of the coating solvent and of the polymeric matte. In general, however, it will be advantageous to provide between about 1.7 and about 9.5 weight %, more preferably between about 2.0 and about 6 weight %, and most preferably between about 2.0 and about 4.0 weight % crosslinking monomer, and use of polymers of the following formula are preferred:

$$(A)_x(B)_y \qquad (I)$$

where A is derived from one or more monofunctional ethylenically unsaturated monomers and, monomer B, the crosslinker, is derived from one or more monomers which contains at least two ethylenically unsaturated groups, x is from about 98.3 to about 90.5 weight %, preferably from about 98 to about 94 and most preferably form about 98 to about 96 weight % and y is from about 1.7 to about 9.5 weight %, preferably from about 2 to about 6 weight %, and most preferably from about 2 to about 4 weight %. If less than about 1.7 weight % crosslinking monomer is included, the polymeric matte may not be sufficiently crosslinked to limit swelling in many coating solvents to less than 390 vol. %. In general, the higher the weight % of crosslinking monomer in the matte, the more resistant the matte will be to swelling in coating solvents, and if crosslinked too much the matte will not swell sufficiently to enable adequate adhesion between the matte and the protective layer.

Suitable ethylenically unsaturated monomers which can be used as component A may include, for example, the following monomers and their mixtures: acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate; the hydroxyalkyl esters of the same acids, such as, 2-hydroxyethyl acrylate, 2-hydroxyethyl methacrylate, and 2-hydroxypropyl methacrylate; the nitriles and amides of the same acids, such as, acrylonitrile, methacrylonitrile, acrylamide and methacrylamide; vinyl compounds, such as, vinyl acetate, vinyl propionate, vinylidene chloride, vinyl chloride, and vinyl aromatic compounds such as styrene, t-butyl styrene, ethylvinylbenzene, vinyl toluene; dialkyl esters, such as, dialkyl maleates, dialkyl itaconates, dialkyl methylene-malonates and the like. Preferably, monomer A is styrene, vinyl toluene, ethylvinylbenzene, methyl methacrylate or mixtures thereof. More preferably monomer A is methyl methacrylate. Most preferably monomer A is a mixture of methyl methacrylate and ethylvinylbenzene.

Suitable ethylenically unsaturated monomers which can be used as component B are monomers which are polyfunctional with respect to the polymerization reaction, and may include, for example, the following monomers and their mixtures: esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate; dienes such as butadiene and isoprene; esters of saturated glycols or diols with unsaturated monocarboxylic acids, such as, ethylene glycol diacrylate, ethylene glycol dimethacrylate, triethylene glycol dimethacrylate, 1,4-butanediol dimethacrylate, 1,3-butanediol dimethacrylate, pentaerythritol tetraacrylate, trimethylol propane trimethacrylate and polyfunctuional aromatic compounds such as divinylbenzene and the like. Preferably, monomer B includes ethylene glycol dimethacrylate, ethylene glycol diacrylate, 1,4-butanediol dimethylacrylate or divinylbenzene. Most preferably, monomer B is divinylbenzene.

As to divinylbenzene, although available as pure monomer for laboratory use, it is most commonly sold commercially as a mixture of divinylbenzene and ethylvinylbenzene, available, for instance, from Dow Chemical Company as DVB-55 (typical assay 55.8% divinylbenzene and 43.0% ethylvinylbenzene) or DVB-HP (typical assay 80.5% divinylbenzene and 18.3% ethylvinylbenzene).

The matte particles for use in accordance with this invention can be made by various well-known techniques in the art, such as, for example, crushing, grinding or pulverizing of polymer down to the desired size, emulsion polymerization, dispersion polymerization, suspension polymerization, solvent evaporation from polymer solution dispersed as droplets, and the like (see, for example, Arshady, R. in "Colloid & Polymer Science", 1992, No 270, pages 717–732; G. Odian in "Principles of Polymerization", 2nd Ed. Wiley (1981); and W. P. Sorenson and T. W. Campbell in "Preparation Method of Polymer Chemistry", 2nd Ed, Wiley (1968)). A preferred method of preparing polymer particles in accordance with this invention is by a limited coalescence technique where polyaddition polymerizable monomer or monomers are added to an aqueous medium containing a particulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577; the disclosures of which are incorporated herein by reference.

Removal of residual monomers from the polymeric matte after synthesis may be desirable, and can be accomplished by any number of methods common to polymer synthesis such as thermal drying, stripping by inert gases such as air or nitrogen, solvent extraction or the like. Drying and stripping processes are limited by the low vapor pressure of the residual monomers and large bead sizes resulting in long diffusion paths. Solvent extraction is therefore preferred. Any solvent can be used such as acetone, toluene, alcohols such as methanol, alkanes such as hexane, supercrital carbon dioxide and the like. Acetone is preferred. While solvents which are effective in removing residual monomers typically dissolve the polymer made from the monomer, or make the polymer sticky and difficult to handle, crosslinked polymers in accordance with the invention are advantageously generally made insoluble in the solvent which has an affinity for the monomer.

The polymeric matte preferably is substantially spherical in shape. The polymeric matte particles preferably have a mean (volume average) particle size of less than about 20 microns in size, more preferably less than about 15 microns, and most preferably less than or equal to about 12 microns in the unswelled state. The matte particles preferably are greater than about 4 microns, more preferably greater than 8 microns.

As discussed above, the protective layer is applied from a solution of the hydrophobic binder in a coating solvent that is a solvent for the polymeric binder and in which the matte swells between about 160 and about 390%. Illustrative coating solvents that can be used include, for example, methylene chloride, methanol, propanol, butanol, tetrahydrofuran, other alcohols, acetone, N-methylpyrrolidone, diglyme, dioxane, N,N-dimethylformamide, pyridine, quinoline, morpholine, ethylene glycol, chloromethane, trichloromethane, carbon tetrachloride, ethylene choride, toluene, xylene, methyl ethyl ketone, methyl isobutyl ketone, ethyl acetate, propyl acetate, cyclohexanone, hexane, heptane, and mixtures thereof. In accordance with this invention the matte swells between about 160% to about 390% in the coating solvent. In the event the coating solvent is a mixture of two or more solvents, it is the degree of swell in the predominant solvent that should be between about 160% and about 390%. A preferred coating solvent comprises methylene chloride.

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

Typical photothermographic imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure*, June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure*, December 1978, Item No. 17029 and *Research Disclosure*, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzene-sulfonamidophenol; benzenesulfonamidophenol; and 2,6-dibromo-4 benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable imaging elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of imaging elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methyl methacrylate), poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable imaging element can comprise a variety of supports. Examples of useful supports are poly(vinylacetal) film, polystyrene film, poly (ethyleneterephthalate) film, poly(ethylene naphthalate) film, polycarbonate film, and related films and resinous materials, as well as paper, glass, metal, and other supports that withstand the thermal processing temperatures.

The layers of the thermally processable imaging element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2, 4bis (tribromomethyl)-s-triazines, such as 6-methyl or 6-phenyl-2, 4bis(tribromomethyl)-s-triazine.

The thermally processable imaging elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

During thermal processing the imaging element is subjected to temperatures close to the glass transition point of the support, binder and matte beads. In view of this, the material used for the support, binder and matte should be capable of surviving such high temperatures. Conventional photographic elements are processable with aqueous processing solutions and are not exposed to the high heat necessary to develop the thermally processable imaging elements. Because of the heat requirements, materials for use in thermally processable imaging typically differ from the materials used in conventional photographic elements. Further, thermally processable imaging elements are transported through heated machinery for processing. Thus, thermally processable imaging elements, which will be transported in a dry state at temperatures close to the softening point of the support, require better matting effectiveness to prevent inadequate transport.

The components of the thermally processable imaging element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

In preferred embodiments of the invention, the protective layer is a backing layer which preferably has a glass transition temperature (Tg) of greater than 50° C., more preferably greater than 100° C.

In certain embodiments of the invention, the protective layer contains a dye. Dyes which can be used include dyes from the following dye classes: anthraquinone, formazan, metal-complexed formazans, azo, metal complexed azo, phthalocyanine, metalophthalocyanine, merocyanine, oxonol, cyanine, hemicyanine, indigo, metal dithiolene, squarylium, methine, azamethine, azacyanine, diazacyanine, oxazine, phenazine, thioxazine, rhodamine, fluoran, pyryllium, thiapyryllium, selenapyryllium, telluropyryllium, benzoquinone, anthrapyridone, stilbene, triphenylmethane, oxoindolizine, indolizine, prophyrazine, thioindigo, croconate, styryl, azastyryl and perlene.

Particularly preferred dyes are, for example, Victoria Pure Blue BO, Victoria Brilliant Blue G, Serva Blue WS, Aniline Blue, Page Blue G-90 and Methylene Blue and phthalocyanine dyes as described in commonly assigned, copending application U.S. Ser. No. 08/978,653, filed Nov. 26, 1997, the entire disclosure of which are incorporated herein by reference.

The amount of dye, if a dye is present in the protective layer, preferably comprises about 1 to about 100, more preferably about 5 to about 50 and most preferably about 10 to about 30 mg/m$^2$.

In the examples the following procedures were used to prepare and evaluate thermally processable imaging elements of the invention.

EXAMPLES 1–6

Preparation of Crosslinked Matte Particles 60 g of 2,2'-azobis(2,4-methylvaleronitrile) (sold as Vazo 52® by DuPont Corp.), 60 g of 2,2'-azobis(2-methylbutyronitrile) (sold as Vazo 67® by DuPont Corp.), and 4.2 g hexadecane are dissolved in a mixture of 4.15 kg of methyl methacrylate and 128.4 g divinylbenzene (55% grade from Dow Chemical Co.). In a separate vessel is added 5.0 kg of demineralized water to which is added 2.4 g potassium dichromate, 15.8 g of poly(2-methylaminoethanol adipate), and 174 gm of Ludox TM®, a 50% colloidal suspension of silica sold by DuPont Corp. The monomer mixture is added to the aqueous phase and stirred to form a crude emulsion. This is passed through a Crepaco homogenizer operated at 350 kg/cm$^2$. The mixture is heated to 45° C. for 16 hours followed by heating to 85° C. for 4 hours. The resulting slurry of solid matte beads are sieved through a 400 mesh sieve screen to remove oversized beads and the desired beads which pass through the screen are collected by filtration. After washing with water and methanol, the filter cake is dried in a vacuum oven for two days at 60° C. followed by one day at 80° C. The crosslinked matte is designated Example 1.

Examples 2 through 5 are prepared in a similar manner except amount of methyl methacrylate and divinylbenzene used are varied per Table I.

Example 6 is prepared in a similar manner except that ethylene glycol dimethacrylate is used as the crosslinking agent. The amounts of methyl methacrylate and ethylene glycol dimethacrylate used are shown in Table I.

TABLE I

| | Wt. % Crosslink | Methyl meth-acrylate | Divinyl-benzene | Ethylene glycol dimethacrylate |
|---|---|---|---|---|
| Example 1 (invention) | 3.0% | 4.15 kg | 128.4 g | — |
| Example 2 (comparison) | 1.5% | 4.21 kg | 64.2 g | — |
| Example 3 (invention) | 2.0% | 4.19 kg | 85.6 g | — |
| Example 4 (invention) | 4.0% | 4.11 kg | 171.2 g | — |
| Example 5 (comparison) | 10% | 3.85 kg | 428.0 g | — |
| Example 6 (comparison) | 10% | 3.85 kg | — | 428.0 g |

To measure the extent of swelling of the polymer in a typical coating solvent, 0.5 gram sample of each sample was added to a 10 ml graduated cylinder followed by 5 grams of methylene chloride. The cylinders were allowed to stand four hours at 25° C. and the level of the swollen beads in the cylinder was measured. While each of the samples were insoluble in the solvents, each exhibited swelling as indicated by the percentage change in bead level from the dry to swollen state as shown in Table II.

TABLE II

| | Wt. % Crosslink | Dry height | Swollen height | % Swell in 4 hrs |
|---|---|---|---|---|
| Example 1 (invention) | 3.0% | 9 mm | 32 mm | 256% |
| Example 2 (comparison) | 1.5% | 8 mm | 40 mm | 400% |
| Example 3 (invention) | 2.0% | 8 mm | 35 mm | 338% |
| Example 4 (invention) | 4.0% | 9 mm | 26 mm | 189% |
| Example 5 (comparison) | 10% | 9 mm | 19 mm | 111% |
| Example 6 (comparison) | 10% | 11 mm | 28 mm | 155% |

EXAMPLES 7–17

Evaluation Examples

Sample protective layers were prepared as follows. In a 5-gallon vessel, 9551.1 g methylene chloride and 208 g butyl alcohol were added. Then 232 g methyl methacrylate polymer (Elvacite 2041 sold by E.I. DuPont de Nemours and Co.) was added slowly with mixing. Mixing was continued for 30 minutes to make sure the polymer had dissolved. Then 7.8 g of a fluorosurfactant (Fluorad™ FC-431 available from Minnesota Mining and Manufacturing Company, St. Paul, Minn.) was added and mixing was continued for an additional 5 minutes. The matte, 1.1 g, was added and mixing continued for an additional 15 minutes.

The resulting composition was coated on a polyester support at a speed of 3048 cm/minutes at a temperature of 21° C.

In these examples the matte used in examples 7–14 and 17 were of methyl methacrylate crosslinked with divinyl benzene and examples 15 and 16 were of methyl methacrylate crosslinked with ethylene glycol dimethylacrylate.

Surface Roughness Evaluation

Film roughness was measured using a vacuum drawdown test. In this test, the element was placed in a vacuum frame and vacuum was applied. Smooth-surfaced elements require greater amounts of time for vacuum drawdown whereas elements having surface roughness imparted by a matting agent require shorter amounts of time for vacuum drawdown. Vacuum drawdown is a measure of the roughness or spacing the matte beads provide relative to their adjacent underlayer. If roughness is low the vacuum drawdown times are greater. Vacuum drawdown times under 20 seconds are acceptable. The results are shown in Tables III–V.

Matte Dusting Evaluation

The coatings of examples 7–17 were evaluated for matte dusting using a table edge matte dusting test that is a qualitative test used to determine the adhesion of matte to its binder. The samples were tested using the following procedure. A weighted film strip was slid up an edge covered with a black receiver material. Three loads (100, 200, and 500 grams) were used and the resulting three white lines of matte formed on the black receiver material at each load were rated from 1 to 4 with 1 being the best and 4 the worst. Dusting ratings below 2 are acceptable. The results are shown in Tables III–V.

TABLE III

| | Wt. % cross-linking | Matte Size | Matte Laydown | Swell | Dust-ing | Vacuum Drawdown |
|---|---|---|---|---|---|---|
| Example 7 (comp) | 10% | 7.8 μm | 5 mg/m$^2$ | 111% | 4+ | 4 seconds |
| Example 8 (comp) | 1.5% | 7.6 μm | 5 mg/m$^2$ | 400% | 3.5 | 7 seconds |
| Example 9 (inv) | 4% | 9.3 μm | 5 mg/m$^2$ | 189% | 1.5 | 5.7 seconds |
| Example 10 (inv) | 2% | 9.6 μm | 5 mg/m$^2$ | 338% | 1.0 | 9.1 seconds |
| Example 11 (inv) | 3% | 9.4 μm | 5 mg/m$^2$ | 256% | 1.0 | 6.7 seconds |

These data show that all examples have acceptable vacuum drawdown (i.e. surface roughness). However, examples 9, 10 and 11 unexpectedly have acceptable dusting while comparative examples 7 and 8 have unacceptable dusting.

TABLE IV

| | Wt. % cross-linking | Matte Size | Matte Laydown | Swell | Dust-ing | Vacuum Drawdown |
|---|---|---|---|---|---|---|
| Example 12 (inv) | 3% | 6.0 μm | 5 mg/m$^2$ | 256% | 1.5 | 20 |
| Example 13 (inv) | 3% | 8.0 μm | 5 mg/m$^2$ | 256% | 1.5 | 11 |
| Example 14 (inv) | 3% | 10.0 μm | 5 mg/m$^2$ | 256% | 1.0 | 7 |

These data show that matte size affects vacuum drawdown. All three examples have acceptable dusting and vacuum drawdown.

TABLE V

| | Wt. % cross-linking | Matte Size | Matte Laydown | Swell | Dust-ing | Vacuum Drawdown |
|---|---|---|---|---|---|---|
| Example 15 (comp) | 10% | 4.0 μm | 2.5 mg/m$^2$ | 155% | 1.5 | >45 |
| Example 16 (comp) | 10% | 5.2 μm | 2.5 mg/m$^2$ | 155% | 2.5 | 18 |
| Example 17 (inv) | 3% | 9.8 μm | 2.5 mg/m$^2$ | 256% | 1.5 | 4 |

These data show (1) for comparative example 15 there was acceptable dusting, but the size of the matte was too small for acceptable vacuum drawdown; (2) for comparative example 16 there was unacceptable dusting but vacuum drawdown was barely under the acceptable limit; (3) for inventive example 17 there was acceptable dusting and acceptable vacuum drawdown. This is unexpected as the matte was much larger than in comparative examples 15 and 16 and one would expect dusting to be unacceptable due to the large matte size, but dusting and vacuum drawdown have been shown to be acceptable.

The invention has been described in detail with particular reference to preferred embodiments, but it will be understood that variations and modifications can be effected within the spirit and scope of the invention.

What is claimed is:

1. A method of preparing a thermally processable imaging element comprising:

(i) coating a thermally processable imaging layer onto one side of a support;

(ii) coating a protective layer on the imaging element by adding a polymeric binder and crosslinked matte particles to a coating solvent in which the binder is soluble and in which the matte swells to the extent of about 160 to about 390 vol. % and coating the resulting composition over the imaging layer or on the support on the side opposite the imaging layer.

2. A method to claim 1, wherein the protective composition is coated on the support on the side opposite the imaging layer.

3. A method according to claim 1 or claim 2, wherein the monomer used to prepare the binder polymer and the monomer crosslinked to prepare the matte are the same.

4. A method according to claim 1, wherein the coating solvent comprises methylene chloride.

5. A method according to claim 1, wherein the polymer of the binder is poly(methyl methacrylate).

6. A method according to claim 1, wherein the matte comprises crosslinked methyl methacrylate.

7. A method according to claim 6, wherein the methyl methacrylate is crosslinked with divinyl benzene or ethylene glycol dimethacrylate.

* * * * *